US007007898B2

(12) United States Patent
Demuth et al.

(10) Patent No.: US 7,007,898 B2
(45) Date of Patent: Mar. 7, 2006

(54) METHOD AND APPARATUS FOR RAILCAR DATA ACQUISITION AND COMMUNICATION

(75) Inventors: Russell Stephen Demuth, Berne, NY (US); Robert Louis Steigerwald, Burnt Hills, NY (US)

(73) Assignee: General Electric Company, Niskayuna, NY (US)

( * ) Notice: Subject to any disclaimer, the term of this patent is extended or adjusted under 35 U.S.C. 154(b) by 490 days.

(21) Appl. No.: 10/064,193

(22) Filed: Jun. 20, 2002

(65) Prior Publication Data

US 2004/0104310 A1 Jun. 3, 2004

(51) Int. Cl.
*B61L 23/34* (2006.01)

(52) U.S. Cl. ..... 246/122 R

(58) Field of Classification Search ..... 246/122 R, 246/124, 167 R, 169 R
See application file for complete search history.

(56) References Cited

U.S. PATENT DOCUMENTS 4,817,040 A * 3/1989 Bodley-Scott ..... 701/35
5,740,992 A * 4/1998 Vogt ..... 246/122 R
6,081,769 A * 6/2000 Curtis ..... 702/158
6,360,998 B1 * 3/2002 Halvorson et al. ..... 246/122 R
6,421,587 B1 * 7/2002 Diana et al. ..... 701/19

* cited by examiner

*Primary Examiner*—S. Joseph Morano
*Assistant Examiner*—Robert J. McCarry, Jr.

(57) ABSTRACT

An apparatus comprising: a data acquisition module adapted for acquiring railcar data from a railcar and generating acquired data; and an electronic transmitter adapted for receiving the acquired data, deriving transmitted data from the acquired data, and transmitting the transmitted data.

32 Claims, 1 Drawing Sheet

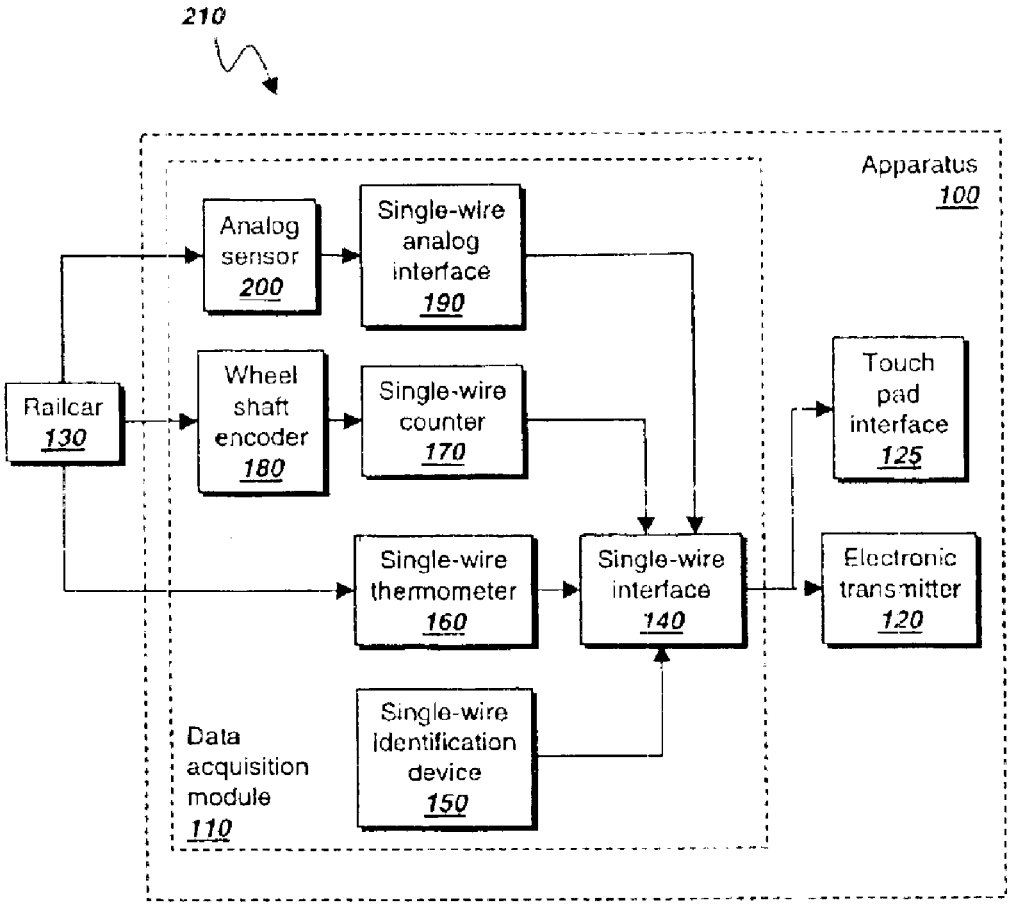
210
Apparatus
100
Analog sensor
200
Single-wire analog interface
190
Railcar
130
Wheel shaft encoder
180
Single-wire counter
170
Touch pad interface
125
Single-wire thermometer
160
Single-wire interface
140
Electronic transmitter
120
Single-wire identification device
150
Data acquisition module
110

METHOD AND APPARATUS FOR RAILCAR DATA ACQUISITION AND COMMUNICATION

BACKGROUND OF INVENTION

The present invention relates generally to the field of data acquisition and communication and specifically to the use of electronic equipment to communicate railcar data among railcars, locomotives, and railway personnel.

In a growing number of applications, railcars are being equipped with electronic communications equipment establishing a data link among railcars, locomotives, and railway personnel. One typical application is an electronic braking system. Rather than relying on brake pipe pressure to initiate railcar braking, electronic braking are transmitted to the railcar's electronic braking system thereby enabling a wider variety of braking strategies useful, for example, in managing slack in the train.

The acceptance by the railroad industry of such railcar electronic communications equipment coupled with the advent of inexpensive local area network (LAN) equipment for acquiring data inside the railcar presents numerous opportunities for communicating new types of railcar data. For example, temperature, pressure, or humidity may be communicated as an aid to monitoring the quality of environmentally sensitive payloads; payload weight, tank level, or bin level may be communicated as an aid to payload management; vibration, bearing temperature, wheel speed, or wheel revolutions may be communicated as an aid to railcar preventive maintenance; and railcar identity may be communicated as an aid to all aspects of railcar management.

SUMMARY OF INVENTION

The opportunities described above are addressed, in one embodiment of the present invention, by an apparatus for railcar data acquisition and communication, the apparatus comprising: a data acquisition module adapted for acquiring railcar data from a railcar and generating acquired data; and an electronic transmitter adapted for receiving the acquired data, deriving transmitted data from the acquired data, and transmitting the transmitted data.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein:

The FIGURE illustrates a block diagram in accordance with one embodiment of the present invention.

DETAILED DESCRIPTION

In accordance with one embodiment of the present invention, the FIGURE illustrates a block diagram of an apparatus 100 for railcar data acquisition and communication, wherein apparatus 100 comprises a data acquisition module 110 and an electronic transmitter 120. Data acquisition module 110 acquires railcar data from a railcar 130 and generates acquired data; electronic transmitter 120 receives the acquired data, derives transmitted data from the acquired data, and transmits the transmitted data to an electronic receiver (not shown) external to railcar 130.

Data acquisition module 110 comprises any electrical or electronic devices or combination thereof capable of performing the indicated functions. Exemplary embodiments of data acquisition module 110 may comprise, singly or in combination: sensing components including, without limitation, analog sensors, digital sensors, and analog-to-digital (A/D) converters; computational components including, without limitation, microprocessors, microcontrollers, single-chip digital signal processors (DSPs), large-, medium-, and small-scale integrated circuits (LSI, MSI, SSI), application specific integrated circuits (ASICs); and communication components including, without limitation, universal asynchronous receiver/transmitters (UARTs) and universal synchronous/asynchronous receiver/transmitters (USARTs).

As defined herein, "railcar data" denotes any characteristic or property of railcar 130 that may be of interest to owners or operators of railcar 130; examples of railcar data include, without limitation, temperature, pressure, humidity, payload weight, tank level, bin level, vibration, bearing temperature, wheel speed, wheel revolutions, and railcar identity.

Railcar 130 comprises any vehicle capable of traveling on railroad tracks; examples of railcar 130 include, without limitation, box cars, ore cars, flat cars, tank cars, and locomotives.

Electronic transmitter 120 comprises any electrical or electronic devices or combination thereof capable of performing the indicated functions. Exemplary embodiments of electronic transmitter 120 may comprise, singly or in combination: computational and communication components similar to those of data acquisition module 110; transmitting components employing, for example, electrical conduction or electromagnetic radiation including, without limitation, radio frequency (RF) radiation and infra-red (IR) radiation; and encoding components implementing signal encoding schemes including, without limitation, amplitude modulation (AM), frequency modulation (FM), on-off keying (OOK), amplitude shift keying (ASK), and frequency shift keying (FSK).

In a more detailed embodiment in accordance with the embodiment of the FIGURE, electronic transmitter 120 wirelessly transmits the transmitted data. As used herein, "wirelessly transmitting" refers to the use of electromagnetic radiation for data transmission. Examples of electromagnetic radiation include, without limitation, RF and IR radiation.

In another more detailed embodiment in accordance with the embodiment of the FIGURE, data acquisition module 110 comprises a single-wire interface 140. Single-wire interface 140 converts single-wire data to acquired data. As used herein, "single-wire data" refers to any data encoded by any communication scheme utilizing only one wire to carry both power and signal and, optionally, a signal return wire. True single-wire communication results if, for example, chassis ground is used for the signal return path. Examples of single-wire interface 140 include, without limitation, the DS2480 Serial 1-WIRE® Line Driver, the DS2480B Serial 1-WIRE® Line Driver with Load Sensor, and the DS2490 USB (Universal Serial Bus) to 1-WIRE® Bridge Chip (1-WIRE® is a trademark of Maxim Integrated Products, Sunnyvale, Calif., hereinafter, "Maxim"). As used herein, all part numbers beginning with "DS" refer to devices manufactured by Maxim.

In another more detailed embodiment in accordance with the embodiment of the FIGURE, data acquisition module 110 further comprises a single-wire identification device 150. Single-wire identification device 150 converts identification data to single-wire data. Examples of single-wire identification device 150 include, without limitation, the DS2401 Silicon Serial Number, wherein the identification data comprises a 48-bit serial number, and the DS2422 1-kbit 1-WIRE® RAM (random access memory) with Counter and DS2423 4-kbit 1-WIRE® RAM with Counter wherein the identification data may comprise, for example, tare weight, manufacturer's name, repair data, service data, or combinations thereof.

In another more detailed embodiment in accordance with the embodiment of the FIGURE, data acquisition module 110 further comprises a single-wire thermometer 160. Single-wire thermometer 160 measures a temperature of the railcar 130 or of a payload and converts the temperature to single-wire data. Examples of single-wire thermometer 160 include, without limitation, the DS18520 1-WIRE® Digital Thermometer.

In another more detailed embodiment in accordance with the embodiment of the FIGURE, data acquisition module 110 further comprises a single-wire counter 170 and a wheel shaft encoder 180. In operation, single-wire counter 170 counts data pulses to yield a data pulse count and converts the data pulse count to single-wire data while wheel shaft encoder 180 generates the data pulses as a function of revolutions of a wheel of railcar 130. Examples of single-wire counter 170 include, without limitation, the DS2422 1-kbit 1-WIRE® RAM (random access memory) with Counter and DS2423 4-kbit 1-WIRE® RAM with Counter. Examples of shaft encoder 180 include, without limitation, incremental optical shaft encoders and incremental magnetic shaft encoders.

In another more detailed embodiment in accordance with the embodiment of the FIGURE, data acquisition module 110 further comprises a single-wire analog interface 190. Single-wire analog interface 190 converts an analog sensor signal from an analog sensor 200 to single-wire data; examples of single-wire analog interface 190 include, without limitation, the DS2450 1-WIRE® Quad A/D Converter. Examples of analog sensor 200 include, without limitation, load cells, vibration sensors, level sensors, pressure sensors, and humidity sensors.

As used herein, "load cell" denotes any device or system for measuring a force; load cells are typically used to measure the weight of a payload and typically comprise strain gauges mounted on structural members with known elastic properties. "Vibration sensor" denotes any device or system for measuring the motion of a surface; embodiments of vibration sensors include, without limitation, accelerometers and optical interferometers. "Level sensor" denotes any device or system for measuring the height of a substantially horizontal surface relative to a reference height; level sensors are typically used to measure the height of the free surface in a storage bin of dry material, or the free surface of a storage tank of liquid material. "Pressure sensor" denotes any device or system for measuring either an absolute or a gauge pressure of a liquid or gas. "Humidity sensor" denotes any device or system for measuring the moisture content of a gaseous atmosphere, typically the moisture content of ambient air.

In another more detailed embodiment in accordance with the embodiment of the FIGURE, data acquisition module 110 further comprises a touch pad interface 125. Touch pad interface 125 communicates the acquired data to an external touch pad (not shown). The external touch pad provides an alternative interface for railcar owners or operators to retrieve the data acquired by data acquisition module 110. Examples of touch pad interface 125 include, without limitation, the DS1991 MultiKey IBUTTON™ device. (IBUTTON™ is a Maxim trademark.) Examples of the external interface include, without limitation, the DS9092 family of IBUTTON™ probes.

In a still more detailed embodiment in accordance with the embodiment of the FIGURE, touch pad interface 125 is further adapted for receiving touch pad data from a second external touch pad not shown. In some embodiments, the second external touch pad is used to provide operator identity information enabling data acquisition module 110 to restrict data access only to authorized personnel.

In another embodiment in accordance with the embodiment of the FIGURE, a system 210 comprises railcar 130 and apparatus 100.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An apparatus for railcar data acquisition and communication, said apparatus comprising:

a data acquisition module adapted for acquiring ralicar data from a railcar and generating acquired data, said data acquisition module comprising a single-wire interface adapted for converting single-wire data to said acquired data;

an electronic transmitter adapted for receiving said acquired data, deriving transmitted data from said acquired data, and transmitting said transmitted data; and a touch pad interface adapted for communicating said acquired data to an external touch pad.

2. The apparatus of claim 1 wherein said electronic transmitter is further adapted for wirelessly transmitting said transmitted data.

3. The apparatus of claim 1 wherein said data acquisition module further comprises a single-wire identification device adapted for converting identification data to said single-wire data.

4. The apparatus of claim 1 wherein said data acquisition module further comprises a single-wire thermometer adapted for measuring a temperature of said railcar and converting said temperature to said single-wire data.

5. The apparatus of claim 1 wherein said data acquisition module further comprises:

a single-wire counter adapted for counting data pulses to yield a data pulse count and converting said data pulse count to said single-wire data; and a wheel shaft encoder adapted for generating said data pulses as a function of revolutions of a wheel of said railcar.

6. The apparatus of claim 1 wherein said data acquisition module further comprises a single-wire analog interface adapted for converting an analog sensor signal from an analog sensor to said single-wire data.

7. The apparatus of claim 6 wherein said analog sensor is selected from a group consisting of load cells, vibration sensors, level sensors, pressure sensors, and humidity sensors.

8. The apparatus of claim 1 wherein said touch pad interface is further adapted for receiving touch pad data from a second external touch pad.

9. A system comprising:

a railcar;

a data acquisition module adapted for acquiring railcar data from said railcar and generating acquired data, said data acquisition module comprising a single-wire interface adapted for converting single-wire data to said acquired data;

an electronic transmitter adapted for receiving said acquired data, deriving transmitted data from said acquired data, and transmitting said transmitted data, said electronic transmitter being further adapted for wirelessly transmitting said transmitted data; and a touch pad interface adapted for communicating said acquired data to an external touch pad.

10. The system of claim 9 wherein said data acquisition module further comprises a single-wire identification device adapted for converting identification data to said single-wire data.

11. The system of claim 9 wherein said data acquisition module further comprises a single-wire thermometer adapted for measuring a temperature of said railcar and converting said temperature to said single-wire data.

12. The system of claim 9 wherein said data acquisition module further comprises:

a single-wire counter adapted for counting data pulses to yield a data pulse count and converting said data pulse count to said single-wire data; and a wheel shaft encoder adapted for generating said data pulses as a function of revolutions of a wheel of said railcar.

13. The system of claim 9 wherein said data acquisition module further comprises a single-wire analog interface adapted for converting an analog sensor signal from an analog sensor to said single-wire data.

14. The system of claim 13 wherein said analog sensor is selected from a group consisting of load cells, vibration sensors, level sensors, pressure sensors, and humidity sensors.

15. The system of claim 9 wherein said touch pad interface is further adapted for receiving touch pad data from a second external touch pad.

16. A method for railcar data acquisition and communication, said method comprising:

acquiring railcar data from a railcar;

generating acquired data from said railcar data;

deriving transmitted data from said acquired data; and transmitting said transmitted data, said step of generating comprising converting single-wire data to said acquired data.

17. The method of claim 16 wherein said step of transmitting comprises wirelessly transmitting said transmitted data.

18. The method of claim 16 wherein said step of converting comprises converting identification date to said single-wire data.

19. The method of claim 16 wherein said step of converting comprises measuring a temperature of said railcar and converting said temperature to said single-wire data.

20. The method of claim 16 wherein said step of converting comprises:

counting data pulses to yield a data pulse count;

converting said data pulse count to said single-wire data; and generating said data pulses as a function of revolutions of a wheel of said railcar.

21. The method of claim 16 wherein said step of converting comprises converting an analog sensor signal from an analog sensor to said single-wire data.

22. The method of claim 21 wherein said analog sensor is selected from a group consisting of load cells, vibration sensors, level sensors, pressure sensors, and humidity sensors.

23. The method of claim 16 further comprising communicating said acquired data to an external touch pad.

24. The method of claim 23 wherein said step of communicating further comprises receiving touch pad data from a second external touch pad.

25. A method for railcar data acquisition and communication, said method comprising:

acquiring railcar data from a railcar;

generating acquired data from said railcar data;

deriving transmitted data from said acquired data; and transmitting said transmitted data, said step of transmitting comprising wirelessly transmitting said transmitted data, said step of generating comprising converting single-wire data to said acquired data.

26. The method of claim 25 wherein said step of converting comprises converting identification data to said single-wire data.

27. The method of claim 25 wherein said step of converting comprises measuring a temperature of said ralicar and converting said temperature to said single-wire data.

28. The method of claim 25 wherein said step of converting comprises:

counting data pulses to yield a data pulse count;

converting said data pulse count to said single-wire data; and generating said data pulses as a function of revolutions of a wheel of said railcar.

29. The method of claim 25 wherein said step of converting comprises converting an analog sensor signal from an analog sensor to said single-wire data.

30. The method of claim 29 wherein said analog sensor is selected from a group consisting of load cells, vibration sensors, level sensors, pressure sensors, and humidity sensors.

31. The method of claim 25 further comprising communicating said acquired data to an external touch pad.

32. The method of claim 31 wherein said step of communicating further comprises receiving touch pad data from a second external touch pad.

* * * * *